United States Patent [19]

Winheim

[11] Patent Number: 4,946,101

[45] Date of Patent: Aug. 7, 1990

[54] ATOMIZER

[75] Inventor: Stefan H. Winheim, Frankfurt, Fed. Rep. of Germany

[73] Assignee: V.I.B. Apparatebau GmbH, Maintal, Fed. Rep. of Germany

[21] Appl. No.: 364,016

[22] Filed: Jun. 9, 1989

[30] Foreign Application Priority Data

Jun. 10, 1988 [DE] Fed. Rep. of Germany ..... 3819762

[51] Int. Cl.[5] ..... B05B 7/10; B05C 9/02

[52] U.S. Cl. ..... 239/8; 239/11; 239/406

[58] Field of Search ..... 239/8, 11, 403, 405, 239/406

[56] References Cited

U.S. PATENT DOCUMENTS

| | | | |
|---|---|---|---|
| 2,785,926 | 3/1957 | Lataste | 239/458 X |
| 3,908,903 | 9/1975 | Burns, Jr. | 239/406 X |
| 4,335,677 | 6/1982 | Nagata et al. | 239/406 X |
| 4,546,923 | 10/1985 | Ii | 239/406 |
| 4,728,035 | 3/1988 | Cruse et al. | 239/122 |

FOREIGN PATENT DOCUMENTS

| | | |
|---|---|---|
| 226757 | 7/1987 | European Pat. Off. . |
| 952765 | 4/1957 | Fed. Rep. of Germany . |
| 1750173 | 8/1970 | Fed. Rep. of Germany . |
| 2535585 | 3/1976 | Fed. Rep. of Germany . |
| 2237717 | 3/1978 | Fed. Rep. of Germany . |
| 2949598 | 7/1980 | Fed. Rep. of Germany . |

*Primary Examiner*—Andres Kashnikow
*Assistant Examiner*—William Grant
*Attorney, Agent, or Firm*—Peter K. Kontler

[57] ABSTRACT

An atomizer wherein a housing is threadedly connected with an air-supplying first nozzle which surrounds and centers a water-supplying second nozzle. The second nozzle extends beyond an annular orifice of a channel which discharges two streams of air, one in the form of a swirling annulus and the other in the form of a substantially straight stream with the annulus. The two air streams atomize the flow of water which issues from the second nozzle in such a way that the resulting atomized flow contains minute droplets of water all the way across its cross-sectional area. An annular swirling member is installed between the two nozzles to form the first air stream. The two nozzles have abutting surfaces provided on two sections one of which surrounds the other to center the second nozzle in the first nozzle and vice versa.

25 Claims, 3 Drawing Sheets

ATOMIZER

BACKGROUND INVENTION

The invention relates to atomizing apparatus in general, and more particularly to improvements in atomizing apparatus which can be utilized for the application of finely atomized liquids to webs of paper or other hygroscopic material.

Commonly owned German Pat. No. 952 765 to Nagler et al. discloses an apparatus which can be utilized to moisturize webs of paper, cardboard, wool, cotton, linen and the like. The atomizers of the patented apparatus employ liquid supplying and gas supplying nozzles each of which is separately connected to the housing of the atomizer by means of threads. A swirling or twisting member is mounted on the liquid supplying nozzle. The directional distribution and quantity of atomizing gaseous fluid are determined by the annular orifice of the respective nozzle. The swirling member sets the outflowing gas in circulatory motion and the circulating stream of gaseous fluid breaks up the flow of air into finely atomized particles. The resulting atomized liquid flow is a hollow cone. Such cone is not ideally suited to ensure uniform wetting of a web of paper or the like. In addition, manufacturing tolerances in connection with the making of threads on the nozzles and in connection with the making of tapped bores in the housing for the nozzles often entail a deformation of the annular orifice so that the width of the orifice is not constant. This results in a distortion of the conical flow of atomized liquid and causes further departures of the moisture profile of treated webs from a desired optimum value.

Published European patent application No. 0 226 757 of Hench discloses an apparatus for making aerosols. The apparatus employs a nozzle with hyperbolical guide means for flowable media and a specially designed turbine chamber. The nozzle is provided with a male insert and a female insert. The apparatus produces a conical spray of dispersed material.

German Offenlegungsschrift No. 29 49 598 of Debard discloses an atomizer which employs a single nozzle for atomizing a highly pressurized fluid such as hair spray.

German Offenlegungsschrift No. 25 35 585 of Bredegaard discloses an atomizer for the application of coats to ceramic materials. The atomizer employs two nozzles including a centrally located liquid-discharging first nozzle and an annular air-supplying nozzle which discharges a single stream of air to act upon the flow of liquid issuing from the orifice of the first nozzle.

German Auslegeschrift No. 22 37 717 to Liedberg discloses an atomizer wherein a centrally located first nozzle discharges a pressurized atomizing agent and an annular nozzle supplies the liquid to be atomized. The atomizer of Liedberg produces a hollow conical or hollow cylindrical spray of atomized material.

German Offenlegungsschrift No. 1 750 173 of Peczeli et al. discloses an oil atomizer wherein a centrally located nozzle conveys a liquid to a plurality of radially outwardly extending orifices which discharge the liquid into a swirling ring-shaped stream of atomizing fluid, such as compressed air. The atomizer of this publication forms a ring-shaped spray of atomized liquid and is said to be particularly suitable for dispersion of highly viscous fluids such as No. 6 fuel oil.

OBJECTS OF THE INVENTION

An object of the invention is to provide an apparatus which can be used for predictable and uniform atomizing of water or other liquids in such a way that the entire cross section of the spray of atomized liquid contains minute droplets of liquid in uniform distribution.

Another object of the invention is to provide an atomizer wherein the configuration of orifices for the flow of gaseous fluid can closely conform to an optimum configuration.

A further object of the invention is to provide a novel and improved combination of nozzles for use in the above outlined apparatus.

An additional object of the invention is to provide a novel and improved atomizer for use in connection with conveyors for webs of paper or other hygroscopic material.

Still another object of the invention is to provide a novel and improved method of atomizing a flow of water or another liquid medium.

A further object of the invention is to provide a method which renders it possible to avoid the development of cavities in sprays or flows of atomized liquid media.

Another object of the invention is to provide a novel and improved arrangement for influencing a stream of gaseous fluid on its way toward contact with a flow of liquid medium which is to be atomized.

SUMMARY OF THE INVENTION

One feature of the invention resides in the provision of an apparatus for atomizing a liquid with a gas, particularly for atomizing water with air. The improved apparatus comprises a housing having a gas-admitting first inlet and a liquid-admitting second inlet, a first nozzle which is installed in the housing and defines a first channel having a first portion communicating with the first inlet and a gas-discharging second portion, and a second nozzle disposed in the first channel and having an end portion extending beyond the second portion of the first channel. The second nozzle defines a second channel having a first portion which communicates with the second inlet and a liquid-discharging second portion in the end portion of the second nozzle. The gas-discharging portion of the first channel has an annular shape and surrounds the second nozzle. One of the nozzles is designed to center the other nozzle, and the nozzles have abutting sections one of which is a tight fit in the other section. The apparatus further comprises a gas swirling device which is installed in the first channel upstream of the gas-discharging portion.

The swirling member and the second nozzle define an annular (e.g., elongated cylindrical) clearance which has a constant width and forms part of the first channel. The sections of the nozzles are preferably disposed in the region of the first portion of one of the channels, particularly in the region of the first portion of the first channel. The aforementioned section of the second nozzle is preferably provided with a conical or cylindrical external surface which is closely adjacent and is surrounded by a cylindrical or conical internal surface of the section of the first nozzle. One of the two sections can be a press fit or a sliding fit in the other section. The common axis of the nozzles preferably coincides with the axes of cylindrical or conical surfaces of the sections which form the tight fit.

The aforementioned section of the first nozzle can be provided with at least one port which forms part of the first channel, and the swirling member is disposed between the gas-discharging portion of the first channel and the at least one port.

The first nozzle and the housing can be provided with mating threads.

The aforementioned section of the second nozzle has a first diameter, and the second nozzle preferably further comprises at least one second section having a second diameter which is smaller than the first diameter.

The housing is preferably provided with a third channel which communicates with the second inlet and connects the latter with the second channel. A sealing element can be installed in the housing in such position that it seals the first channel from the second channel and from the additional channel. An extension of the second nozzle is preferably received in the additional channel and defines the liquid-receiving first portion of the second channel.

Another feature of the invention resides in the provision of a method of wetting webs of paper or other hygroscopic material. The method comprises the steps of imparting to a first gas stream a swirling movement about a predetermined axis so that the first stream is converted into a ring-shaped mass of gaseous fluid, maintaining the first stream at a relatively low pressure, conveying a second gas stream in the direction of the axis (i.e., within the ring-shaped mass of gaseous fluid), supplying a flow of liquid into the first and second gas streams so that the flow of liquid is atomized by both streams and forms an atomized liquid flow having a substantially circular cross section and being at least substantially free of voids, and advancing a web of hygroscopic material across the atomized liquid flow or vice versa. The pressure of the second gas stream is preferably maintained at or close to the pressure of the first gas-stream.

The supplying step can include placing a liquid discharging nozzle into the path of the air streams so that the gas streams surround and flow along the nozzle toward its liquid discharging orifice.

The novel features which are considered as characteristic of the invention are set forth in particular in the appended claims. The improved atomizing apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
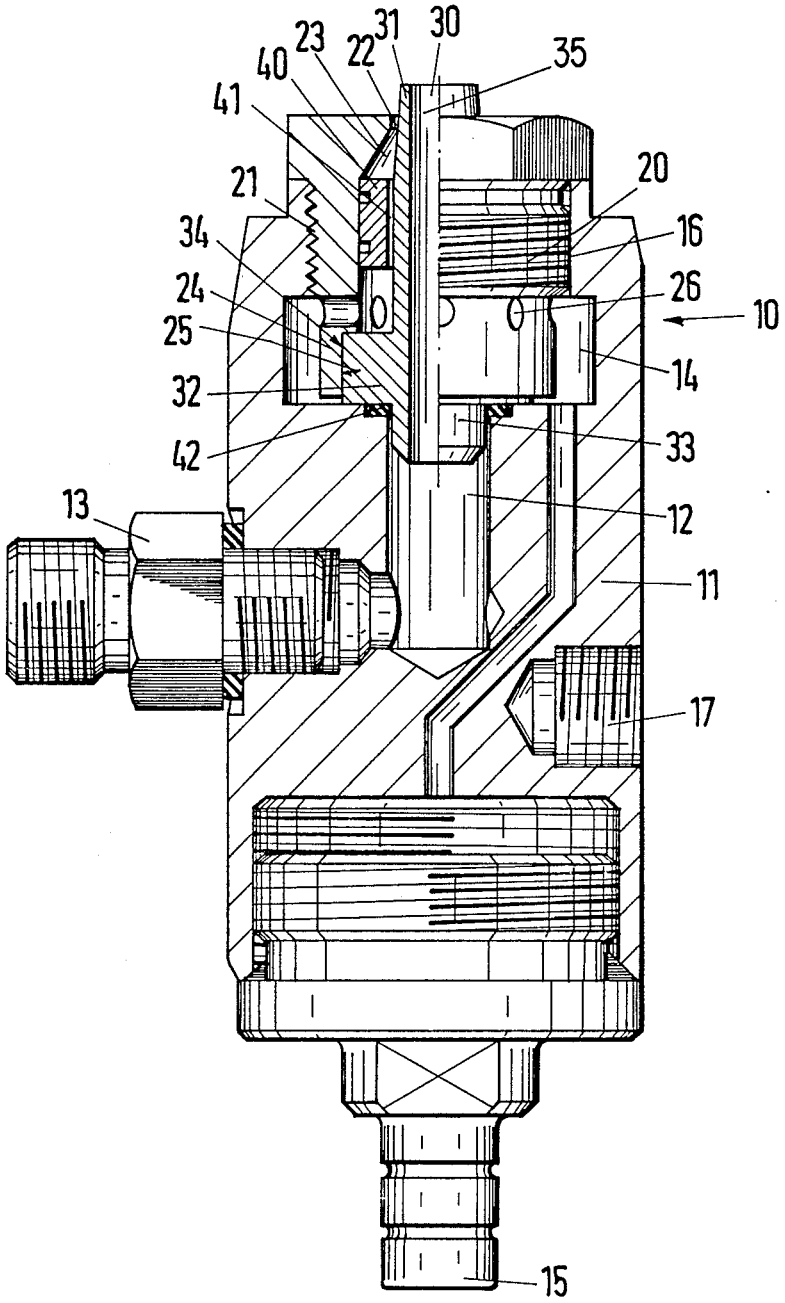
FIG. 1 is a partly elevational and partly axial sectional view of an atomizing apparatus which embodies one form of the invention.

Referring first to FIG. 1, there is shown an atomizing apparatus 10 (hereinafter called atomizer) which has a substantially cylindrical housing or body 11, a first nozzle 20 which receives air at relatively low pressure from a first inlet of the housing 11, a second nozzle 30 which receives a flow of liquid from a second inlet of the housing 11, and an annular swirling or twisting member 40 which is installed in the nozzle 20. The first inlet is defined by a first nipple 15 at one axial end of the housing 11, and the second inlet is defined by a second nipple 13 which extends substantially radially of the housing.

The housing 11 is further provided with a substantially axially extending channel 12 which communicates with the second inlet (nipple 13) and with an axially extending channel 35 defined in part by the slender elongated main section 31 of the nozzle 30. The slightly conical front end portion of this section 31 extends from the housing 11 of the atomizer 10 beyond the nozzle 20, and the channel 35 has a liquid-discharging (second) portion in the front end portion of the section 31. The liquid-receiving (first) portion of the channel 35 is provided in an extension 33 which forms part of the nozzle 30 and is received in the channel 12 of the housing 11. The outer diameter of the extension 33 matches or approximates the outer diameter of the section 31.

The first nozzle 20 defines, in part alone, in part with the second nozzle 30, in part with the housing 11 and in part with the swirling member 40, a composite channel 14 having a first portion which communicates with the first inlet (nipple 15) of the housing 11 and a gas-discharging second portion 22 which is an annular orifice surrounding the section 31 of the nozzle 30. The maximum-diameter portion of the channel 14 communicates with the inlet which is defined by the nipple 15 by way of one or more passages which are provided in the housing 11 in front of and/or behind the plane of FIG. 1.

The housing 11 is further provided with at least one substantially radially extending taped bore 17 for reception of a portion of a threaded fastener (not shown) which secures the atomizer 10 to a support in a machine for wetting webs of paper or other hygroscopic material. The wetting action can involve moving the housing 11 relative to the web and/or vice versa.

The front end portion of the housing 11 (namely the end portion which is remote from the nipple 15) is provided with an internal thread 16 mating with an external thread 21 of the nozzle 20. The channel 14 includes an elongated portion 23 which is disposed between the nozzles 20, 30 and the cross-sectional area of which decreases in a direction toward the annular air-discharging portion or orifice 22. A larger-diameter section 24 of the nozzle 20 in the maximum-diameter portion of the channel 14 has a precision-finished cylindrical or conical internal surface 25 which closely surrounds and abuts a complementary cylindrical or conical external surface 34 on a section 32 of the nozzle 30. The outer diameter of the section 32 is larger than the outer diameter of the section 31 and/or extension 33, and the section 32 is a tight fit (such as a press fit or a sliding fit) in the section 24 of the nozzle 20. Thus, the internal surface 25 of the section 24 centers the nozzle 30 by way of the external surface 34 of the section 32.

Figure 5:
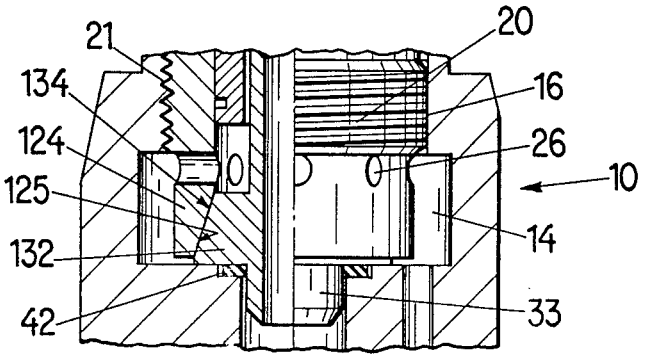
FIG. 5 is a fragmentary partly elevational and partly sectional view of a modified atomizing apparatus.

The conical surface 125 of a larger-diameter section 124 of a modified nozzle 120, and the complementary conical surface 134 of a modified section 132 are shown in FIG. 5.

The nozzle 20 is further formed with one or more (e.g., with a complete annulus of equidistant) radially extending bores or ports 26 which are provided in the section 24 adjacent the section 32 and serve to convey air from the maximum-diameter portion of the channel 14 to the portion 23 wherein air which is admitted via a nipple 15 can flow toward and into the annular portion or orifice 22.

An important advantage of the tight fit between the sections 24, 32 of the nozzles 20 and 30 is that the annular portion or orifice 22 of the channel 14 has a constant width all the way around the adjacent tapering end portion of the section 31. In addition, such tight fit and the resulting accurate centering of the nozzle 30 in the nozzle 20 ensures that the section 31 and the swirling member 40 define a relatively long cylindrical clearance 41 which forms part of the channel 14 and is located upstream of the annular portion or orifice 22 and upstream of the conical internal surface of the nozzle 20 immediately upstream of the annular portion 22. The swirling member 40 is or can be a tight fit in the portion 23 of the channel 14 within the confines of the nozzle 20. The width of the annular clearance 41 is constant all the way around the section 31 of the nozzle 30.

A sealing element 42 surrounds the extension 33 of the nozzle 30 and bears against an internal shoulder of the housing 11 to seal the channel 14 from the channel 35 as well as from the channel 12. The section 24 of the nozzle 20 has an internal shoulder which overlies the adjacent end face of the section 32. This ensures that the sealing element 42 is compressed between the section 32 and the internal shoulder of the housing 11 when the nozzle 20 is fully inserted into the housing, i.e., when a requisite length of the external thread 21 mates with the internal thread 16. The exposed end of the nozzle 20 has a hexagonal outline to facilitate the application of a wrench or another suitable torque applying tool.

When the improved atomizer 10 is in use, the nipple 13 is connected to a source of liquid by a hose or the like, not shown, so that the channel 35 of the nozzle 30 discharges a flow of liquid, such as water. The pressure of liquid issuing from the tapering end portion of the section 31 is relatively low, e.g., only slightly above atmospheric pressure.

Figure 2:
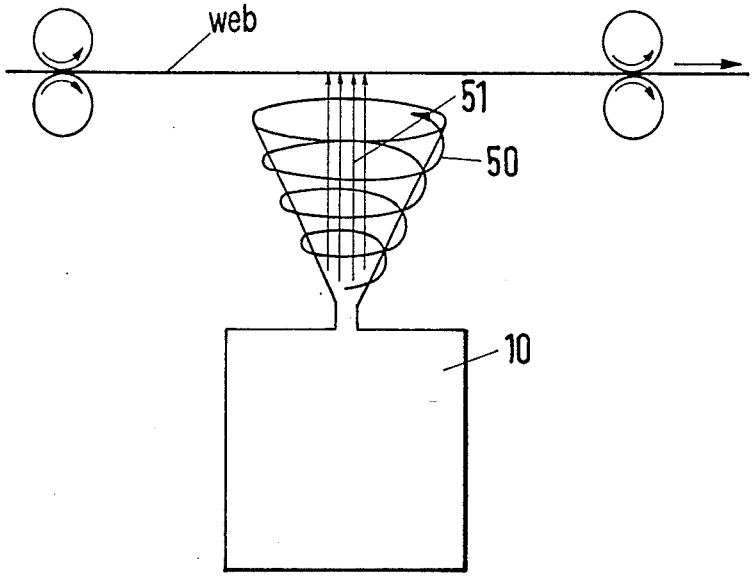
FIG. 2 is a diagrammatic elevational view of the apparatus of FIG. 1 and further shows the shapes of gas streams which issue from the fluid-discharging portion of the first channel.

The nipple 15 is connected to a source of pressurized gaseous fluid, e.g., to an air compressor, which admits gas into the channel 14. The ports 26 convey the admitted gas from the maximum-diameter portion of the channel 14 into the portion 23 which surrounds the section 31 of the nozzle 30. A first part of the gas stream which is admitted into the portion 23 is swirled by the member 40 to form a swirling stream 50 (FIG. 2) having a ring-shaped cross-sectional outline and contacting the outermost layer of the flow of liquid issuing from the end portion of the section 31. The swirling stream 50 of gaseous fluid circulates about the common axis of the nozzles 20, 30 and centering surfaces 25, 34. As the stream 50 flows along and beyond the end portion of the section 31, it breaks up the adjacent layer of the liquid flow into minute droplets so that such layer is converted into a finely atomized flow of liquid particles. The pressure of atomized flow of liquid particles is very low which is highly desirable when the flow is used to moisturize a running web of paper or the like FIG. 2, because the droplets of atomized liquid are readily accepted and retained by the web.

The second or remaining portion of the gas stream which is admitted into the channel portion 23 via ports 26 (namely the portion which is not converted into the swirling stream 50) is caused to flow in the axial direction of the stream 50 to form a second stream 51. The direction of the second stream 51 is determined by the annular clearance 41 between the swirling member 40 and the external surface of the section 31 of the nozzle 30. The second stream 51 flows along and beyond the external surface of the exposed front end portion of the section 31 to thereby advance in parallelism with the axis of the nozzle 30 and with the axis of the swirling stream 50.

Figure 3:
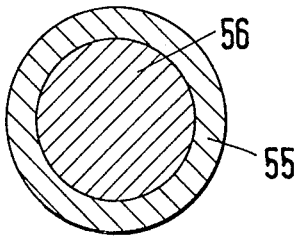
FIG. 3 is a schematic cross-sectional view of the atomized liquid flow.

FIG. 3 shows the area which is wetted by a flow of atomized liquid which is formed by the streams 51 and 52. Such area has a substantially circular outline and includes a ring-shaped outer portion or region 55 and a circular inner portion or region 56 which completely fills the space within the outer portion 55. This ensures a highly predictable and thorough moisturizing or wetting of a web of paper or the like. The portion 55 is formed primarily by liquid which has been atomized by the stream 50, and the portion 56 is formed primarily by liquid which has been atomized by the stream 51.

Figure 4:
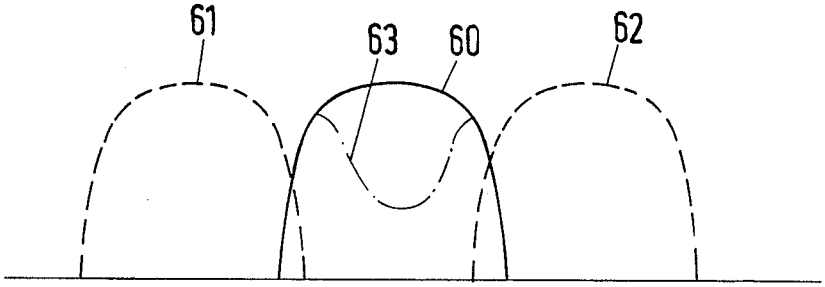
FIG. 4 is a diagram showing the manner in which a web of paper or the like can be moisturized with a battery of three atomizing apparatus of the type shown in FIG. 1, the moisturizing action of a conventional atomizing apparatus being indicated by phantom lines.

The moisture profile of a web of paper or the like which is wetted by one or more atomizers of the type shown in FIG. 1 can be seen in FIG. 4. The moisture profile which is established by a single atomizer 10 is shown by the curve 60, and the moisture profiles which are provided by two additional atomizers of the type shown in FIG. 1 are indicated by broken lines, as at 61 and 62. It will be noted that such moisture profiles partially overlap (i.e., the three atomizers are placed sufficiently close to each other to ensure that the flows of atomized liquid which issue from their housings partially overlap each other) and that the combined profile is substantially uniform, i.e., with relatively small hills and valleys.

The phantom line 63 denotes the moisture profile of a web which has been caused to pass along the discharge end of a conventional atomizing apparatus. It will be readily seen that this moisture profile is much less satisfactory than those shown at 60, 61 and 62. The profile 63 is obtained when a conventional atomizer merely discharges a conical spray of atomized liquid.

When an annular spray of atomized liquid which issues from a conventional atomizer is directed against a stationary web of paper or the like, the spray moisturizes a ring-shaped portion of the web, i.e., such ring-shaped portion surrounds a central portion or core which remains dry or receives much less moisture than the ring-shaped portion. With reference to FIG. 3, this would mean that the spray of atomized liquid would wet only the region 55 but not the region 56. The lack of uniformity of moisturizing action which can be achieved with conventional atomizers is even more pronounced if two or more conventional atomizers are used to apply sprays of atomized liquid in such a way that the spray which is produced by one of the atomizers overlies in part the spray which is produced by an adjoining atomizer. The regions where the annular sprays overlap are subjected to a very pronounced moisturizing action whereas certain portions of the web remain dry or their moisture content is increased only slightly, namely to a minute fraction of the moisture content of those portions of the web where the neighboring annular sprays overlap each other.

The improved atomizer 10 overcomes the drawbacks of conventional atomizers in that, in addition to forming the annular stream 50 of gaseous fluid, it also forms a second stream 51 which flows in parallelism with the common axis of the nozzles 20, 30 and ensures the development of a spray of atomized liquid within the annular spray which is formed as a result of contact between the liquid issuing from the section 31 of the nozzle 30 and the stream 50.

As a rule, or in many instances the percentage of moisture in the annular region 55 is likely to be somewhat less than the percentage of moisture in the central region 56. This can be compensated for by the simple expedient of causing the sprays of atomized liquid which issue from neighboring atomizers 10 to partially overlap each other as shown in FIG. 4. Thus, and in contrast to heretofore known proposals, partial overlapping of sprays of atomized liquid which are obtained with atomizers embodying the present invention enhances the uniformity of the combined moisturizing action.

An advantage of the feature that the sections 24, 32 with abutting precision-finished centering surfaces 25, 34 are remote from the annular portion 22 of the channel 14 is that the centering surfaces cannot influence the atomizing action of the air streams 50, 51 upon the flow of liquid which issues from the section 31 of the nozzle 30. On the other hand, the centering action of the surfaces 25, 34 upon the nozzles 20 and 30 is highly satisfactory.

The feature that the surface 25 of the section 24 of the nozzle 20 surrounds the surface 34 of the section 32 of the nozzle 30 exhibits the advantage that the nozzle 30 can be readily inserted into and centered in the nozzle 20. Such insertion takes place from below, as seen in FIG. 1, before the nozzle 20 is threadedly connected to the housing 11.

A press fit between the sections 24 and 32 has been found to be highly satisfactory. As mentioned above, the surfaces 25, 34 can have a cylindrical or conical shape. An advantage of conical surfaces is that they can serve to limit the extent of axial movability of the nozzle 30 relative to the nozzle 20 in one direction.

At least one of the surfaces 25, 34 is preferably a circumferentially complete cylindrical or conical surface. This enhances the reliability of the centering action. Moreover, this ensures that the width of the annular portion or orifice 22 of the channel 14 remains constant all the way around the section 31 of the nozzle 30.

The ports 26 are adjacent one axial end of the section 32 of the nozzle 30 and serve to convey air from the maximum-diameter portion of the channel 14 into the channel portion 23, i.e., into the range of the swirling member 40. An advantage of the feature that the swirling member 40 is installed between the annular portion or orifice 22 and the ports 26 of the channel 14 is that the gas which enters the portion 23 is set in rotary motion with a minimum of turbulence which enhances the uniformity of the atomizing action.

While it is equally possible to provide discrete threaded connections between the housing 11 and each of the nozzles 20, 30, the illustrated construction wherein a threaded connection is provided only between the nozzle 20 and the housing 11 is preferred at this time because it contributes to a reduction of the cost and also because the nozzle 20 constitutes the last element, as seen in the direction of flow of pressurized gas, which is acted upon by the gas. The other two separately produced components (namely the nozzle 30 and the swirling member 40) are held in optimum positions by the nozzle 20.

As can be seen in FIG. 1, the outer diameter of the section 32 exceeds the outer diameters of the other two parts 31 and 33 of the nozzle 30. This is desirable and advantageous because the large-diameter section 32 provides a large surface 34 which contributes to stability of the atomizer 10 and to the centering action of the surfaces 25, 34.

The channel 12 of the housing 11 communicates with the large-diameter portion of the channel 14 when the nozzles 20 and 30 are detached from the housing 11. This simplifies the making of the housing 11. However, once the sealing element 42 is placed around the extension 33 of the nozzle 30 and the nozzle 20 is connected to the housing 11, the channel 12 is reliably sealed from the channel 14. The extension 33 is an optional but desirable feature of the nozzle 30. This extension facilitates proper application of the sealing element 42. The latter is adequately compressed and deformed to seal the channels 12, 14 from each other as soon as the nozzle 20 is properly attached to the housing 11. In other words, the element 42 establishes a reliable seal between the channels 12, 14 in automatic response to threading of the nozzle 20 into the housing 11.

The pressure of gas in the stream 51 preferably matches or rather closely approximates the pressure of gas in the stream 50. This exhibits the advantage that the web of paper or the like which is acted upon by the flow of atomized material is subjected to an even more uniform moisturizing action. In addition, it is not necessary to provide two discrete sources of gas wherein the gas is maintained at different pressures. The pressure of gas which forms the streams 50 and 51 is preferably low.

Atomizers of the type to which the present invention pertains can be utilized in apparatus similar to those which are disclosed in commonly owned copending patent applications Ser. Nos. 144,934 (filed Jan. 15, 1988 for "Apparatus for contacting running webs of fibrous material with fluids") and 302,075 (filed Jan. 24, 1989 for "Method of and apparatus for contacting running webs with steam and the like").

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for atomizing a liquid with a gas, particularly for atomizing water and air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections; and a gas swirling member disposed in said first channel upstream of said gas-discharging portion, said swirling member and said second nozzle defining an annular clearance forming part of said first channel and having a substantially constant width.

2. The apparatus of claim 1, wherein said sections are disposed in the region of the first portion of one of said channels.

3. The apparatus of claim 1, wherein said section of said second nozzle has an external surface and said section of said first nozzle has an internal surface surrounding said external surface.

4. The apparatus of claim 1, wherein said tight fit is a press fit.

5. The apparatus of claim 1, wherein said tight fit is a sliding fit.

6. The apparatus of claim 1, wherein said sections have abutting cylindrical surfaces, said nozzles having a common axis coinciding with the axes of said surfaces.

7. The apparatus of claim 1, wherein said sections have abutting complementary conical surfaces.

8. The apparatus of claim 1, wherein said section of said first nozzle has at least one port forming part of said first channel.

9. The apparatus of claim 1, wherein said first nozzle and said housing have mating threads.

10. The apparatus of claim 1, wherein said section of said second nozzle has a first outer diameter and said second nozzle includes an additional section having a second diameter smaller than said first diameter.

11. The apparatus of claim 1, wherein said housing has a third channel connecting said second inlet with the first end of said second channel, and further comprising sealing means provided in said housing between said first channel on the one hand and said second and third channels on the other hand.

12. The apparatus of claim 1, wherein said housing has an additional channel communicating with said second inlet, said second nozzle having an extension in said additional channel and said first end of said second channel being provided in said extension and communicating with said additional channel.

13. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections one of which is a tight fit in the region of the first portion of one of said channels; and a gas swirling member disposed in said first channel upstream of said gas-discharging portion.

14. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections, said section of said second nozzle having an external surface and said section of said first nozzle having an internal surface surrounding said external surface; and a gas swirling member disposed in said first channel upstream of said gas-discharging portion.

15. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a press fit in the other of said sections; and a gas swirling member disposed in said first channel upstream of said gas-discharging portion.

16. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a sliding fit in the other of said sections; and a gas swirling member disposed in said first channel upstream of said gas-discharging portion.

17. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said nozzles and said nozzles having abutting sections, said sections having abutting cylindrical surfaces and said nozzles having a common axis coinciding with the axes of said surfaces; and a gas swirling member disposed in said first channel upstream of said gas-discharging portion.

18. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid-discharging second portion in said end portion, said gas discharging portion of said first channel having an annular shape and surrounding said second nozzle, one of said nozzles centering the other of said nozzles and said nozzles having abutting sections one of which is a tight fit in the other of said sections, said sections having abutting complementary conical surfaces; and a gas swirling member disposed in said first channel upstream of said gas-discharging portion.

19. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections, said section of said first nozzle having at least one port forming part of said first channel; and a gas swirling member disposed in said first channel upstream of said gas-discharging portion.

20. The apparatus of claim 19, wherein said swirling member is disposed between said gas-discharging portion and said at least one port.

21. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections, said section of said second nozzle having a first outer diameter and said second nozzle including an additional section having a second diameter smaller than said first diameter; and a gas swirling member disposed in said first channel upstream of said gas-discharging portion.

22. Apparatus for atomizing a liquid with a gas, particularly for atomizing water with air, comprising a housing having a gas-admitting first inlet and a liquid-admitting second inlet; a first nozzle installed in said housing and defining a first channel having a first portion communicating with said first inlet and a gas-discharging second portion; a second nozzle disposed in said first channel and having an end portion extending beyond the second portion of said first channel, said second nozzle defining a second channel having a first portion in communication with said second inlet and a liquid discharging second portion in said end portion, said gas discharging portion of said first channel having an annular shape and surrounding said second nozzle, one of said nozzles centering the other of said nozzles and said nozzles having abutting sections one of which is a tight fit in the other of said sections, said housing having a third channel connecting said second inlet with the first portion of said second channel; sealing means provided in said housing between said first channel on the one hand and said second and third channels on the other hand; and a gas swirling member disposed in said first channel upstream of said gas-discharging portion.

23. A method of wetting webs of paper or other hygroscopic material, comprising the steps of imparting to a first gas stream a swirling movement about a predetermined axis while maintaining the first stream at a relatively low pressure; conveying a second gas stream in the direction of said axis; supplying a flow of liquid into said first and second gas streams so that the flow of liquid is atomized; and advancing a web of hygroscopic material across the atomized liquid flow.

24. The method of claim 23, further comprising the step of maintaining the pressure of the second gas stream at or close to the pressure of the first gas stream.

25. The method of claim 23, wherein said supplying step includes placing a liquid discharging nozzle into the path of said gas streams so that said gas streams surround the nozzle.

* * * * *